United States Patent [19]

Kircher et al.

[11] 4,101,410

[45] Jul. 18, 1978

[54] ELECTRODE ASSEMBLY WITH FLEXIBLE GAS BAFFLE CONDUCTOR

[75] Inventors: Morton S. Kircher, Eaton, N.Y.; Maynard F. Engler, Cleveland, Tenn.

[73] Assignee: Olin Corporation, New Haven, Conn.

[21] Appl. No.: 836,458

[22] Filed: Sep. 26, 1977

[51] Int. Cl.[2] ..... C25B 13/00; C25B 11/03; C25B 9/00

[52] U.S. Cl. ..... 204/282; 204/266; 204/283; 204/288

[58] Field of Search ..... 204/286, 288, 289, 266, 204/282–283, 225

[56] References Cited

U.S. PATENT DOCUMENTS

| | | | |
|---|---|---|---|
| 3,930,151 | 12/1975 | Shibata et al. | 204/266 X |
| 3,941,676 | 3/1976 | Macken | 204/286 X |
| 3,963,596 | 6/1976 | Kircher | 204/286 X |
| 4,033,849 | 7/1977 | Pohto et al. | 204/288 X |
| 4,059,500 | 11/1977 | Kamarian | 204/289 X |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

An electrode assembly is disclosed which includes a common electrode riser and two opposed working faces. A movable, electrically conductive, downwardly opening gas baffle is provided between the faces to connect the faces to the riser and to bias the faces away from one another. The baffle also directs flow of electrically produced gases between the faces from an upward to a primarily sideways direction parallel to said faces. A diaphragm can surround the electrode assembly, if desired.

A method of assembling a diaphragm-type electrolytic cell is disclosed. The method includes placing a low friction protective sheet over an outer end of one of a plurality of electrode units and forcibly interleaving the protected electrode units with a plurality of other electrode units so as to contact the other electrode units by compressive forces applied to the other electrode units through the protective sheet and then removing the protective sheet so as to allow the other electrode units to expand against the formerly protected electrode unit.

Further disclosed is an expandable electrode assembly having at least two opposed working faces and a biasing device attached to each of the working faces for biasing the faces away from each other so as to expansively bias the assembly. An adjustable contraction device is attached to the bias device in order to contract the bias device and move the faces toward each other into a first position spaced a selected distance from one another. A releasable restraint device is also provided in order to hold the faces in the first position and selectively release the faces to move from the first position to a second position spaced a greater distance from onw another than the selected distance. The restraint means can be a member which will corrode responsive to the presence of a corrosive medium thereabout.

22 Claims, 10 Drawing Figures

ELECTRODE ASSEMBLY WITH FLEXIBLE GAS BAFFLE CONDUCTOR

This invention relates to an expandable electrode assembly for an electrolytic cell of the diaphragm-type and to a method for the assembly thereof.

"Diaphragm-type" as used herein shall mean an electrolytic cell having either a porous or nonporous layer separating the anodes and cathodes of the cell. A common method of assembling such a diaphragm-type electrolytic cell is to place the diaphragm material directly onto the cathode by applying a vacuum to the cathode and immersing the evacuated cathode into a solution or suspension containing asbestos fibers or other suitable fibers. The applied vacuum draws the fibers against the cathode to form a porous layer or "diaphragm" adherent to the cathode structure. Typically, such a cathode is then interleaved between two anode structures to produce an electrolytic cell. An example of such an electrolytic diaphragm cell is the cell disclosed in U.S. Pat. No. 3,898,149 issued Aug. 5, 1975 to Morton S. Kircher, et al. The Kircher et al cell is a tubular housing enclosing a plurality of planar interleaved cathodes and anodes, the cathodes having an applied layer of diaphragm material thereon. Such a cell can also be fabricated with use of a synthetic diaphragm material substituted for the adherent vacuum-deposited diaphragm layer disclosed therein. In more recent times, the adherent diaphragm, and even the synthetic diaphragm have been replaced by experimental "membranes", which are cation permeable and thus serve to produce a higher purity caustic product.

Each of the above types of diaphragm cells and membrane cells suffer from an inherent assembly problem. The efficient operation of an electrolytic cell requires that the anode to cathode gap be held at the minimum distance possible taking into account the need for gaseous products to be removed from the anode and cathode surfaces. This close minimum spacing results in abrasion of the separative layer, be it a diaphragm or membrane, during the interleaving process. The anodes and cathodes must pass between one another in order to achieve an interleaved planar electrode configuration. The electrodes are often flexible or semi-flexible mesh surfaces of non-uniform orientations and configurations prior to assembly. This results in the aforementioned abrasion of the separative layer unless precautions are taken to protect the separative layer during such assembly.

One method of protecting the separative layer from damage due to abrasion is the construction of the anodes with a flexible, electrically conductive, internal spring to either expand or contract the posed planar faces of the electrode units. Typical of such a structure are the expandable electrodes disclosed in U.S. Pat. No. 3,674,676 issued July 4, 1972 to E. I. Fogelman, which discloses a vertical anode having a vertical riser connected to two planar mesh surfaces by a vertical spring. The spring is either inwardly or outwardly biased and is provided with suitable clamps or spacer bars to maintain the faces either inward or outward. The electrode is installed in the contracted position so as to increase the anode to cathode gap. Either the clamp is removed or spacer bars are inserted in order to allow the electrode to expand or to force the electrode to expand, respectively, in order to achieve minimum anode to cathode spacing following the interleaving process. However, the Fogelman electrodes have no discernable effect upon gas flow other than to perhaps partially block gas flow. The Fogelman electrode also suffers from the necessity of manipulating spacer bars or clamps between the working faces following installation of the electrodes, which is an akward and sometimes impossible task. This is especially so when the anode is enclosed by a membrane or diaphragm where the spacer bars and clamps are inaccessible.

A different method of protecting the diaphragm is that disclosed in U.S. Pat. No. 4,014,775 issued Mar. 29, 1977 to M. S. Kircher and M. F. Engler, the inventors of the present invention, herein incorporated by reference as if set forth at length, which discloses use of protective covers positioned between the diaphragm and a continuous spacer net, the protective covers being removed prior to the final assembly of anodes and cathodes. However, the specific nature of the protective covers is not disclosed, as the primary emphasis of that patent is the use of a continuous net.

Another method of temporarily increasing the anode to cathode gap during interleaving of planar electrodes is the adjustable electrode disclosed in U.S. Pat. No. 4,026,785 issued May 31, 1977 to J. M. Ford. The Ford electrode employs removable clamps to hold the outer end of either the cathodes or the anodes in contracted position while the anodes or cathodes, respectively, are inserted therebetween. The clamping means are then removed to allow the contracted cathodes or anodes to expand to a normal position with minimum anode to cathode spacing. The Ford electrode has no effect upon gas flow through the electrode as the clamps are removed immediately following assembly of the electrodes in interleaved configuration. Also, the Ford electrode uses risers which are directly attached to the working faces of each electrode to expand the electrode. Yet another adjustable electrode is that disclosed in U.S. Pat. No. 4,028,214 issued June 7, 1977 to J. M. Ford and E. N. Macken. In which the clamps are placed on the outside of the electrode where they are readily accessible and where the interelectrode can be conveniently changed. The Ford and Macken adjustable electrode also employs a second clamp which directly connects the working faces with the electrode riser and which is easily accessible from the outside of the electrode. While this adjustable electrode greatly improves upon the inherent difficulties in the Fogelman electrode, once again no provision is made to deliberately effect gas flow through the electrode unit. Yet another variable gap electrode assembly is that disclosed in U.S. Pat. No. 4,028,213 issued June 7, 1977 to J. M. Ford. This second Ford electrode assembly includes a crank member which, upon rotation thereof, moves the electrode risers laterally with respect to a support plate upon which the electrodes are mounted so as to increase or decrease the thickness of the anodes by means of a simple external cranking operation. A modified prior version of a crank-adjusted electrode is the adjustable electrode disclosed in U.S. Pat. No. 3,941,676 issued Mar. 2, 1976 to E. N. Macken. This Macken adjustable electrode employs an eccentric, rotatable electrode riser attached to each of two spaced working surfaces. The eccentric structure of the electrode riser serves to increase or decrease the thickness of the electrode responsive to rotation of the riser. As with the other versions of adjustable electrodes above noted, the Macken electrode fails to enhance the flow of gas within the electrode.

Thus there is a need for an electrode unit which will provide maximum anode to cathode gap during the interleaving process and yet be easily expanded following the process and which will also serve to enhance the flow of gas through the electrode unit. This becomes of special significance when the adjustable electrode is enclosed by a diaphragm or membrane prior to expansion thereof.

A prior electrode structure which considers gas flow within the electrode unit is U.S. Pat. No. 3,963,596 issued June 15, 1976 to Morton S. Kircher. This Kircher electrode includes a conductive horizontal support having one end attached substantially perpendicular to an electrode plate and having a selected curvature of from about 2° to about 30° from the axis of the attached end. This Kircher assembly resembles a planar electrode with straight risers except that the risers appear to be "J"-shaped. The selected curvature serves to help direct the flow of gases from normal upward direction to a partially sideways direction parallel to the working faces. The Kircher electrode can be a gas directing element or "baffle" which opens downwardly and lies immediately below the electrode risers. This baffle serves to channel the upward flow of gases along the bottom edge of the electrode riser either inwardly toward the attached end or outwardly away from the attached end in order to help collect gases along either the inner or outer edge of the planar electrode where a suitable outlet conduit can be provided. However, the Kircher electrode has no provision whatsoever for adjustment of the thickness of the electrode in order to solve the abrasion problem above noted.

A solution to these and other problems is provided by the present invention which provides an electrode assembly comprising a vertically inclined common conductor bar, at least two opposed electrode working faces and movable electrically conductive, downwardly opening gas baffle means. The gas baffle means connects the working faces to the conductor bar for biasing the working faces away from one another and for redirecting flow of gases between said working faces from an upward to a primarily sideways direction parallel to said faces.

Also provided by another aspect of the invention is a method of assembling a diaphragm-type electrolytic cell having a first plurality of expansively biased, contractable electrode units interleaved with a second plurality of electrode units which comprises the steps of placing a low fraction temporary protective sheet over an outer end of one of said first and second pluralities of electrode units, forcibly interleaving said first and second pluralities of electrode units so as to contract said expansively biased contractable electrode units by compressive forces applied to said contractable electrode units through said protective sheet, and removing said protective sheet so as to allow said first plurality of electrode units to expand against said second plurality of electrode units.

A still further aspect of the invention provides the above-mentioned electrode assembly with an outward bias means attached to each of the working faces for biasing the faces away from each other and an adjustable contraction means, attached to the bias means, for contracting said bias means and moving said faces toward each other until said faces are in a first position spaced a selected distance from one another and a releasable restraint means for holding said faces in said first position and selectively releasing said faces to move from said first position to a second position spaced a greater distance from one another than said selected distance.

The restraint means can be corrodable responsive to the presence of a corrosive medium to allow automatic expansion of the electrode when placed in said corrosive medium for a predetermined time.

The invention will be better understood when considered in connection with the attached drawing, in which FIG. 1 is a top plan view of an electrolytic cell showing in cutaway cathodes and anodes partially interleaved;

Figure 1:
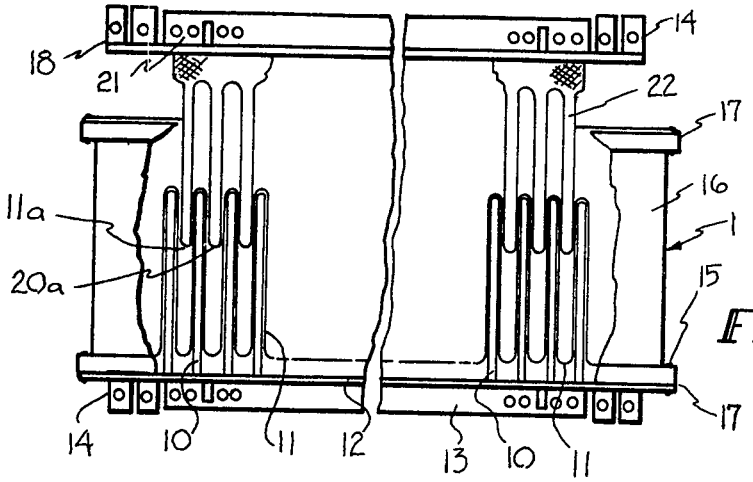
Figure 2:
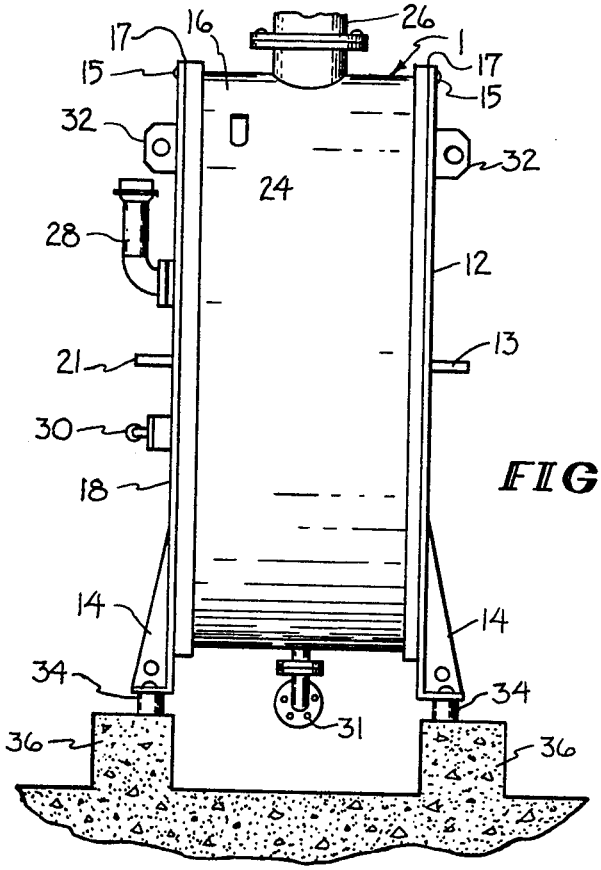
FIG. 2 is a side elevational view of the cell of FIG. 1 in fully assembled condition.
Figure 3:
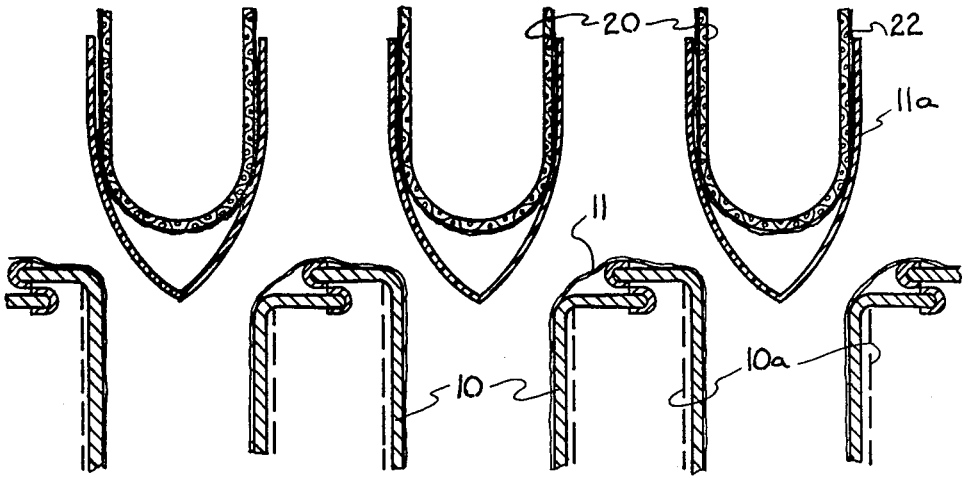
FIG. 3 is a close-up, horizontal, cross-sectional view of a plurality of electrodes immediately prior to installation thereof.

Referring now to the figures more specifically, FIG. 1 shows an electrolytic cell 1 having foraminous metal anodes 10 attached to anode support 12. Anodes 10, although expandable in the invention, are depicted in FIG. 1 and FIG. 3 without the apparatus for expansion. A cell body 16 is sealingly attached to anode support 12 by gasket 17 and bolts 15, although any suitable sealed attachment means can be substituted for gasket 17 and bolts 15. Cathodes 20, attached to a cathode support 18, are covered by a suitable diaphragm 22. The diaphragm 22 can be applied by vacuum forming in the case of a conventional asbestos fiber type diaphragm or by suitable clamping means as in the case of a synthetic fabric-like diaphragm or membrane. Particularly suitable for diaphragm 22 would be a copolymer comprised of a perfluorosulfonic acid resin such as marketed by DuPont de Nemours under the trademark NAFION or a perfluorocarboxylic acid resin such as manufactured by Asahi Glass and disclosed in Japanese Patent Publication No. 1976-126398 by Asahi Glass Kabushiki Gaisha published Nov. 4, 1976, respectively. Cathodes 20 are shown partially inserted between foraminous metal anodes 10. A continuous net 11 covers the surface of foraminous metal anodes 10 which would otherwise come in direct contact with diaphragm 22. Conductor 13, attached to anode support 12, introduces current to electrolytic cell 1 while conductor 21, secured to cathode support 18, removes current from the cell 1. Support brackets 14 are attached to anode support 12 and cathode support 18 for purposes below described. Slip sheets **11*a*** are shown covering and protecting the outer end 20*a* of cathode 20. Sheets 11*a* are sheets of material with a low coefficient of friction suitable for allowing easier insertion of cathodes 20 between anodes 10 while protecting diaphragm 22 from abrasion which can otherwise occur due to abrasive contact between diaphragm 22 and continuous net 11. Netting 11 serves to maintain given minimum spacing between diaphragm 22 and anodes 10 in order to provide freer gas flow upwardly along the outer surface of anodes 10. Slip sheets 11*a* would be removed following completion of the interleaving operation so as to allow diaphragm 22 to rest directly against net 11.

FIG. 14 depicts a side view of assembled electrolytic cell 1 where anode support 12 and cathode support 18 are positioned vertically. An aqueous alkali metal halide solution to be electrolyzed enters cell body 16 through a brine inlet 24. Halogen gas is removed through a halogen gas outlet 26 while hydrogen gas is removed through outlet 28 and caustic liquor through outlet 30. A drain 31 is provided to permit the contents of the cell to be removed. Lugs 32 enable the positioning and removal of anode support 12 and cathode support 18. Electrolytic cell 1 is supported by brackets 14 attached to anode support 12 and cathode support 18 and bolted to insulators 34 resting on platform 36. Anode backplate or support 12 and cathode backplate or support 18 are attached to cell body 16 by gasket 17 and bolts 15, as above noted. Current enters cell 1 via conductor 13 and exits cell 1 via conductor 21 as noted above. Cell body 16 can be of tubular structure as shown or can be of any other conventional configuration such as square, rectangular or triangular. While the electrodes of FIGS. 1 and 3 are shown horizontally cantilevered, the electrodes can also be vertically supported by anode or cathode posts (not shown) in a configuration such as is commonly referred to as a "Hooker-type" cell.

FIG. 3 is a horizontal, cross-sectional view showing the interleaving operation in greater detail. Cathodes 20, having diaphragm 22 thereon, are shown provided with slip sheets 11*a* surrounding and protecting the outer ends 28 thereof. Metal anodes 10 are shown in their expanded position covered by net 11. Upon the insertion of cathodes 20 between anodes 10, anodes 10 will contract due to the contact between slip sheet 11*a* and net 11 which arises from the insertion of cathodes 20 between anodes 10. Contracted anodes 10*a* are shown by dotted lines to indicate the contraction of anodes 10 responsive to the insertion of cathodes 20. Upon completion of this interleaving operation, slip sheets 11*a* can be simply removed by pulling them upwardly out of the space between anodes 10 and cathodes 20.

Figure 4:
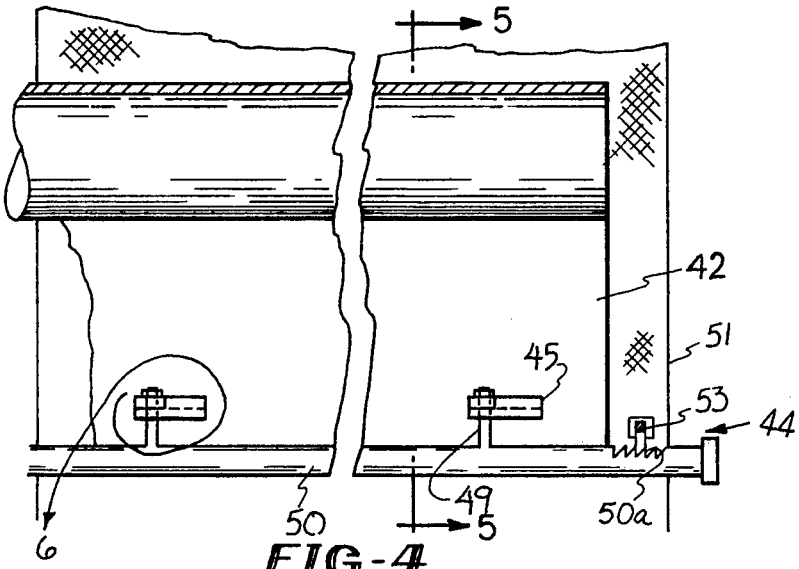
FIG. 4 is a vertical, longitudinal, cross-sectional view of an expandable electrode showing a first preferred restraint means.
Figure 5:
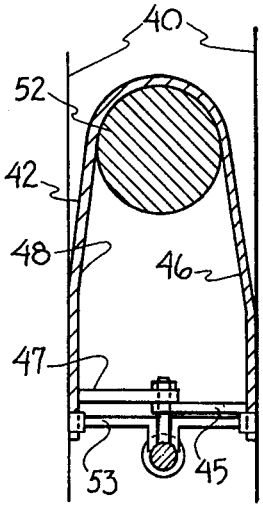
FIG. 5 is a vertical, transverse, cross-sectional view of the expandable electrode of FIG. 4 taken along lines 5—5.

FIG. 4 is a vertical, cross-sectional view showing the interior of one preferred form of anode 10. FIG. 5 is a vertical, cross-sectional view of the anode of FIG. 4. The interior surface 40 of anode 10 is attached by welding or otherwise to a spring conductor 42. Spring conductor 42 can be an inverted, U-shaped, metallic conductor which is outwardly biased so as to tend to expand anode 10 to an outward expanded position, yet which is sufficiently flexible to allow contraction of anode 10 responsive to compressive forces applied thereto. Conductor 42 is provided with a suitable restraint means 44 which comprises a plurality of first horizontal levers 45 attached to one end 46 of spring conductor 42, a plurality of second horizontal levers 47, a plurality of vertical pivots 49, a notched pushrod 50 and a horizontal latch bar 53 attached to a second end 48 of spring conductor 42. Horizontal levers 45 and 47 are connected at their inner ends by a suitable vertical pivot 49 which in turn is attached to a push rod 50 which lies generally horizontal and runs longitudinally between the opposed interior surfaces 40 of anode 10 and passes outwardly beyond outer ends 51 of surfaces 40 so as to enable operation of push rod 50 by manipulations outside of anode 10. Conductor 42 passes over a conductor bar or electrode riser 52 and is attached to the upper surface of conductor bar 52 by welding or otherwise. Alternatively, conductor 42 could be suitably bent to pass below conductor bar 52 and be attached to the lower surface of bar 52. Spring conductor 42 is of sufficient width that when either contracted or expanded, surfaces 40 will be spaced from conductor bar 52. Also seen in FIGS. 4 and 5 is a horizontal latch bar 53 which engages corresponding recesses or notches 50*a* of push rod 50 so as to maintain push rod 50 and associated levers 45 in a predetermined position relative to metal anode 10. This predetermined position is such that metal anode 10 is in a contracted position. A plurality of notches 50*a* are preferably provided in order to allow adjustment of push rod 50 in order to vary the thickness of metal anode 10 and achieve a given desired thickness thereof.

FIG. 5 is a transverse, vertical, cross-sectional view taken along lines 5—5 of FIG. 4 restraint means 44. Spring conductor 42 is seen to be an inverted U-shaped member passing upwardly over conductor bar 52 and attached to interior surfaces 40 at suitable points below conductor bar 52. Ends 46 and 48 of spring conductor 42 are attached to the outer ends of horizontal levers 45 and 47. The inner ends of levers 45 and 47 are in turn rotatably connected to vertical pivot 49. Pivot 49 has an upper end attached to levers 45 and 47 and a lower end attached to push rod 50. Restraint means 44 can be inverted from the position shown in FIGS. 4 and 5. Also seen in FIG. 5 is a horizontal latch bar 53 which serves to engage push rod 50 and connected levers 45 and 47 in a pre-determined position.

Figure 6:
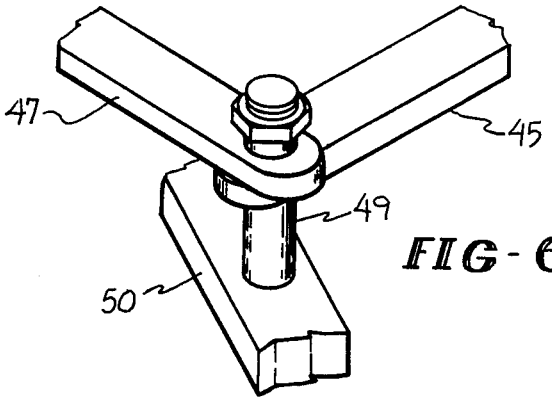
FIG. 6 is a close-up, isometric, overhead view of portion 6 of FIG. 4.

FIG. 6 is a close-up, isometric view of the connection of levers 45 and 47 to pivot 49 and of pivot 49 to push rod 50. Levers 45 and 47 are connected in a V-shaped position to the upper end of pivot 49 and the lower end of pivot 49 is in turn attached to the push rod 50 by any conventional means such as welding or by suitable threads thereon. It will be understood that as push rod 50 is either pushed or pulled, the outer ends of levers 45 and 47 will be brought closer together or further apart and metal anode 10 will be correspondingly contracted or extended. As noted above, a latch bar 53 serves to maintain a contracted or expanded position by engaging push rod 50.

Figure 7:
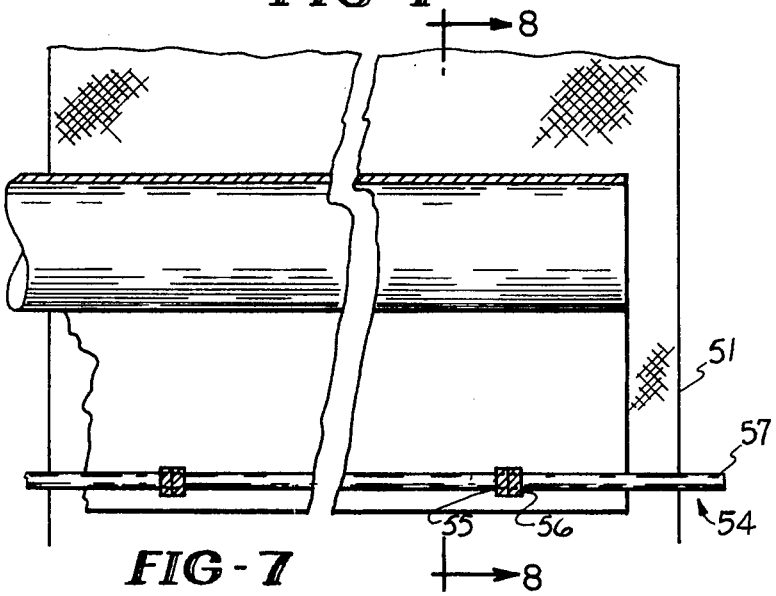
FIG. 7 is a vertical, longitudinal, cross-sectional view of a second expandable electrode having a second preferred restraint means.

An alternative restraint means 54 is shown in FIG. 7, which is a vertical longitudinal cross-sectional view of a modified version of metal anode 10. Horizontal lugs 55 and 56 have been substituted for levers 45 and 47 of FIGS. 4, 5 and 6. A corrodable wire 57 passes through apertures 58 of the inner ends of lugs 55 so as to maintain the inner ends of lugs 55 connected until such time as corrodable wire 57 is removed. Corrodable wire 57 can be steel when utilized to maintain anode 10 in connected position. Corrodable wire 57 could also be an aluminum wire if used to maintain a cathode having corresponding interior lugs (not shown) and corresponding spring conductors and conductor bars. In the case of the cathode, it will be realized that a conductor bar is not necessary if the mesh surfaces of the cathode are made sufficiently conductive to carry the current supplied thereto during electrolysis. A corrodable wire 57 preferably passes beyond the outer end 51 of anode 10 so as to enable removal of wire 57 by external manipulation, such as pulling outwardly on wire 57, in the event difficulty is encountered necessitating expansion of anode 10 prior to corrosion of corrodable wire 57.

Figure 8:
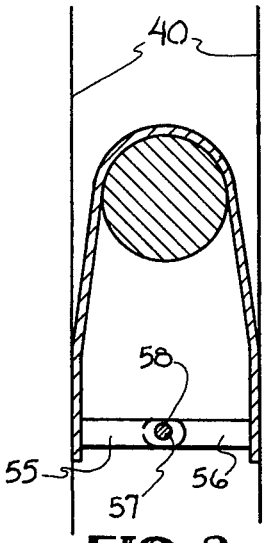
FIG. 8 is a transverse, cross-sectional view of the expandable electrode of FIG. 7 taken along lines 8—8 of FIG. 7.

FIG. 8 shows a vertical cross-sectional view of restraint means 54 taken along lines 8—8 of FIG. 7. Lugs 55 and 56 are cantilevered from the interior surfaces 40 of anode 10 and have overlapping inner ends with apertures 58 lying about corrodable wire 57 so as to maintain lugs 55 and 56 in overlapped position. In practice, this overlapped position is the position assumed by lugs 55 and 56 when metal anode 10 is contracted. The corrodable nature of wire 57 allows the enclosure of anode 10 with a diaphragm or membrane while still achieving release of restraint means 54, thus avoiding the necessity of manipulations of restraint means 54 and achieving an automatic expansion of anode 10 responsive to the placement of anode 10 in a corrodable medium and the subsequent corrosion of wire 57 which releases lugs 55 from lugs 56. While a particular structure for lugs 55 and 56 is shown in FIGS. 7 and 8, it will be understood that any suitably structured lugs can be substituted for lugs 55 and 56 so long as the lugs each are attached to and restrained by wire 57.

Figure 9:
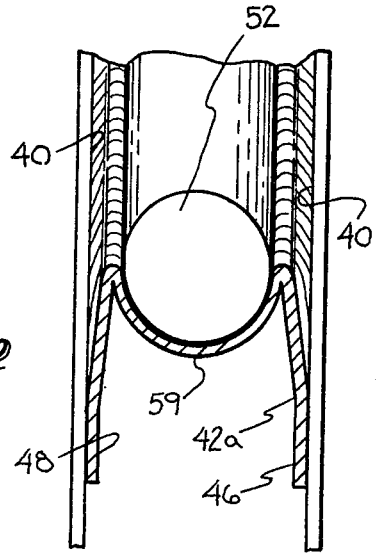
FIG. 9 is a transverse, cross-sectional view of an unrestrained expandable electrode embodying a preferred form of the invention.

FIG. 9 is a transverse, vertical, cross-sectional view of a further modified spring conductor **42*a*. Spring conductor 42*a* passes under conductor bar 52 rather than over conductor bar 52 as was the case with spring conductor 42. Therefore, spring conductor 42*a* has an inverted W-shaped structure with the middle portion 59 underlying and attached by welding or other suitable connection means to the lower surface of conductor bar 52. As with spring conductor 42, spring conductor 42*a* serves to channel upward flow of gases to a sideways flow pattern which assists in the removal of gaseous electrolytic products from between interior surfaces 40 while avoiding the tendency of conductor bar 52 to direct such gas flow outwardly through interior surfaces 40 to the exterior of metal anode 10**.

Figure 10:
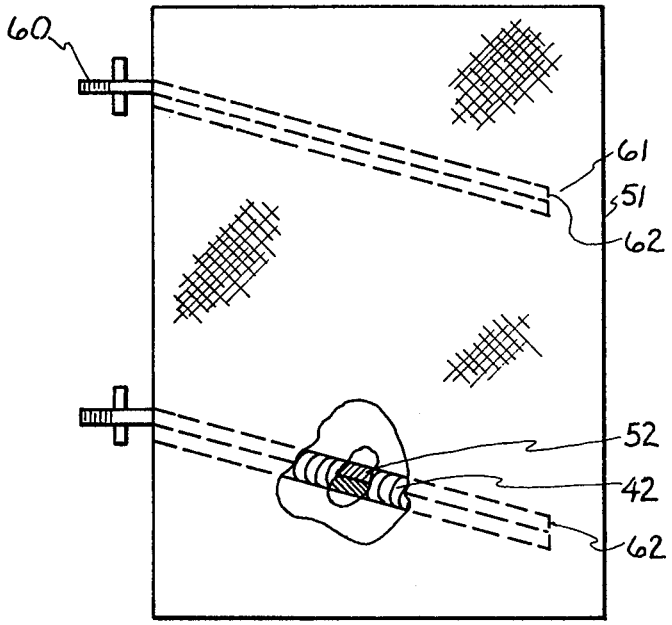
FIG. 10 is a side view of an expandable electrode showing in cutaway an inclined gas baffle flexible conductor.

FIG. 10 is a side elevational view of an individual metal anode having vertically inclined conductor bar 52 and having spring conductor 42 vertically inclined in conformance with inclined conductor bar 52. Conductor bar 52 passes outwardly from between surfaces 40 and can be provided with suitable threads 60 or other attachment means for connection to anode support 12. Conductor bar 52 and spring conductor 42 can outwardly terminate at a point between interior surfaces 40 at a point spaced inwardly from outer end 51 of the metal anode so as to provide an outer passageway 61 beyond the outer end 62 of conductor bar 52 and spring conductor 42 associated therewith. This passageway 61 serves to allow upward liquid flow between interior surfaces 40 outwardly from ends 62 in order to avoid blockage or collection of gases.

The thickness of spring conductors 42 and **42*a* will be determined both from the standpoint of providing adequate outward bias pressure to interior surfaces 40 and providing adequate electrical conductivity. The thickness range can preferably be from about 0.010 inch to about 0.100 inch. It is preferred to have the thickness approximately the same as the thickness of the foraminous metal sheets forming metal anode 10. The length of the spring conductor is determined by three principle factors, which are: (a) to provide adequate halogen gas collecting capacity, (b) to provide the proper combination of pressure and travel as a spring, and (c) to be sufficiently limited for economy of power during operation and material cost during fabrication. It is preferred that the distance from the outer end 62 of the spring conductor 42 to the point of attachment to interior surfaces 40** be from about 1 to about 3 inches.

The netting 11 referred to, may be woven or nonwoven Teflon filament netting or Teflon coated glass netting or netting produced from slip sheeting. The material can be any type which will endure under the service conditions of electrolytic operation of cell 1. A preferred netting is one having 4–12 mesh (strands per lineal inch) with filaments of from about 0.010 inch to about 0.04 inch diameter. A suitable commercially available netting of this type is sold by Dodge Industries, Inc. and designated as Catalogue No. 384-30/1 Teflon Coated Glass Netting. U.S. Pat. No. 4,014,775, above incorporated by reference, describes and claims suitable nettings for use as netting 11.

Having described the structure of several embodiments of the invention, the operation of the invention will now be described. Referring to FIG. 3, expandable metal anodes 10 are covered with a suitable netting 11 and outer ends **20*a* of cathodes 20 bearing diaphragm 22 are covered by slip sheet 11*a* and inserted between anodes 10 thus contracting expandable anodes 10 responsive to the outward force upon anodes 10 by slip sheet 11*a* as the cathodes 20 are inserted therebetween. Anodes 10 contract to a contracted position 10*a* having a pre-determined spacing from cathodes 20. Anodes 10 can be provided with a restraint means 44 or 54 in order to minimize the contact between slip sheet 11*a* or cathodes 20 and netting 11** during the interleaving operation.

Restraint means 44 is operated by pushing or pulling upon push rod 50 in order to expand or contract anode 10. Push rod 50 extends to the exterior of anode 10 so as to allow this pushing or pulling to be done outside of anode 10. In the embodiment of FIGS. 4, 5 and 6, push rod 50 would be pushed inwardly toward support 12 until anode 10 is contracted a desired amount. Latch bar 53 engages recesses **50*a* upon inward movement of push rod 50 to prevent subsequent undesired expansion of anode 10 and hold anode 10 in contracted position during the interleaving operation. Push rod 50 is attached to interior surfaces 40 by V-shaped levers 45 and 47 which rotate so as to bring surfaces 40 closer together responsive to the pushing of push rod 50. Levers 45 and 47 are shown connected on their outer ends to ends 46 and 48 of spring conductor 42, but it will be readily understood that levers 45 and 47 could be connected directly to surfaces 40 if so desired. While spring conductor 42 is shown horizontal in FIGS. 4 and 5, from FIG. 10 it will be understood that spring conductor 42 is preferably, although not necessarily, sloped upwardly toward support 12 in order to direct gas flow toward support 12**.

FIG. 1 generally shows the tubular unit cell of U.S. Pat. No. 3,898,149 issued Aug. 5, 1975 to M. S. Kircher et al herein incorporated by reference as if set forth at length, with rigid metal anodes 10 thereof replaced by expandable anodes 10 of the present application. In the event a membrane impermeable to hydraulic flow is utilized, the cell would be modified to provide a spent brine outlet and a catholyte inlet. In this regard, reference is made to U.S. Patent Application Ser. No. 782,643 filed Mar. 30, 1977 now U.S. Pat. No. 4,078,987 by S. J. Specht, herein incorporated by reference as if set forth at length, which discloses a modified version of the tubular unit cell of said U.S. Pat. No. 3,898,149. The Specht cell can have an expandable cathode rather than an expandable anode as described in FIGS. 1–10 of the present specification, or can have an expandable membrane enclosed anode similar to that described in said FIGS. 1–10. However, it is readily apparent from the present specification that the cathodes of the Specht cell could advantageously be provided with gas baffling, flexible, spring conductors similar to spring conductors 42 or 42*a* of FIGS. 4, 5, 7, 8, 9 and 10 with or without conductor bars 52 as desired and without restraint means 44,54 or other restraint means since the vacuum assembly method thereof can provide suitable contractive force upon either cathode or anode, as desired.

Reference is also made to U.S. Pat. Nos. 3,932,261, issued Jan. 13, 1976 and 4,008,143, issued Feb. 15, 1977, and both by M. S. Kircher and J. A. Wood which disclose conductor bars which also serve as gas deflectors and which patents are herein incorporated by reference as if set forth at length to note that spring conductor 42 or 42*a* could be connected to a pair of conductor bars such as conductive supports 36 and 38, 40 and 42 or 44 and 46 of FIG. 3 of said U.S. Pat. Nos. 3,932,261 and 4,008,143.

It will also be understood that if the diaphragm 22 or corresponding membrane shown in FIGS. 1 and 3 is deleted, oxychlorine compounds such as alkali metal hypochlorites or alkali metal chlorates can be produced. Such cells are seen in U.S. Pat. Nos. 1,862,244; 2,370,087; 2,987,463; 3,461,057; 3,617,461 and 3,642,604. Even without diaphragm 22, the invention may still find use in protecting anodes from abrasion against corresponding cathodes and vice versa. This is especially true in light of the trend toward metal electrodes having delicate catalytic coatings plated thereupon which could be damaged by abrasion.

It will be appreciated from the disclosure that the spring conductors 42 or 42*a* could also be used with crank-operated restraint means such as shown in U.S. Pat. No. 3,941,676 issued Mar. 2, 1976 to E. N. Macken, herein incorporated by reference as if set forth at length, the spring conductor serving to both conduct current to or from the electrode while collecting and directing gas flow through the electrode. This could be done by attaching clips 16 of the Macken electrode to spring conductors 42 or 42*a* and would serve to avoid any tendency of shaft 14 of Macken to undesirably direct gas flow out of the space between surfaces 10 of the Macken electrode.

While conductor bars 52 are shown in FIG. 10 as being bent into a straight horizontal portion and a straight vertically inclined portion, herein incorporated by reference as if set forth at length for U.S. Pat. No. 3,963,596, issued June 15, 1976 to M. S. Kircher, which dicloses upwardly or downwardly curved conductor bars 28 with a preferred conductive gas baffle or gas directing element 32 thereof, the conductor bars being directly attached to the interior surfaces of the electrode.

While slip sheets 11*a* and net 11 are shown in the figures of this disclosure, U.S. Pat. No. 3,975,255 issued Aug. 17, 1976 to M. S. Kircher is herein incorporated by reference as if set forth at length to show that spacers 25 thereof could be utilized in place of both sheets 11*a* and net 11 hereof without detriment to the invention. Such spacers 25 would, unlike slip sheets 11*a*, remain after installation in order to maintain spacing of the electrodes and anodes of the cell.

The advantage of having an automatic expansion of the electrode without external manipulation or expansion of the electrode in response to some external signal or manupulation or physical condition is better seen when the present disclosure is considered along with the disclosure of U.S. Pat. No. 3,980,544, issued Sept. 14, 1976 to J. O. Adams et al, herein incorporated by reference as if set forth at length, which discloses a fabricated glovelike diaphragm which encloses the anode of a cell such as that of FIG. 1. Prior art expandable anodes such as U.S. Pat. No. 3,674,676 issued July 4, 1972 to E. I. Fogelman, herein incorporated by reference as if set forth at length, will now allow for expandable anodes enclosed by a membrane or fabricated diaphragms since spacer bars or clamps must be removed therefrom following interleaving of electrodes during assembly of the cell.

While the above drawings depict several preferred embodiments, the above description and incorporated references will suggest many other modifications to the invention. The following example and claims are intended to cover all such modifications as fall within the scope of the invention.

EXAMPLE 1

An anode of 24 square feet of planar electrode surface is constructed in the manner shown in FIG. 10. The two 36 inch by 48 inch planar surfaces are fabricated from flattened expanded titanium mesh approximately 0.072 inch thick. The titanium-clad copper rods or conductor bars are 1 inch diameter with 0.040 inch thick titanium-cladding. The conductor bars are horizontal at the attachment end, and slope downward at a 1 to 4 slope toward the opposite edge. The conductor bars terminate 4 inches from the opposite edge to provide a passageway for electrolyte rise upward between the titanium sheets. Attachment of the titanium sheets to the 1 inch diameter conductor rods is made with a 0.072 inch thick titanium strip 5 inches wide which is formed in the shape of an inverted "U" passing over the upper surface of the conductor bars. Connection between the strip or spring conductor and the interior surfaces of the expanded titanium mesh and between the spring conductor and the upper surface of the conductor bar is completed by welding.

In operation, a sodium chloride brine solution is fed into a cell containing the above described electrode surface to produce a caustic product, a chlorine gas product, a hydrogen gas by-product and a spent brine solution. Chlorine bubbles form on the outside surfaces of the titanium mesh but are forced through the openings in the mesh to a chamber between the titanium mesh sheets because the diaphragm and a surrounding spacer netting on the outside thereof obstruct upward passage of the gas. On the inside of the titanium mesh sheets, the rising gas bubbles collect under the inverted "U" shaped spring conductors and travel upward along the underside of the spring conductors to a channel provided at the connection end of the anodes. The rising gas tends to create a gas lift effect which induces electrolyte flow upward through the chamber. The spring conductors, in addition to collecting and transporting chlorine gas and conveying current to the anode surfaces, also maintain a pressure to hold the anode surfaces against the netting, diaphragm and cathode.

What is claimed is:

1. An electrode assembly which comprises:

a. a vertically inclined common electrode conductor bar;

b. at least two opposed electrode working faces; and c. movable, electrically-conductive, downwardly opening, gas baffle means for connecting said faces to said conductor bar, for biasing said working faces away from one another and for redirecting flow of gases between said working faces from an upward to a primarily sideways direction parallel to said faces.

2. The electrode assembly of claim 1 wherein said gas baffle means lies generally horizontal and has a curved lower surface.

3. The electrode assembly of claim 1 wherein said gas baffle means is connected to each of said working faces and to only a single upper side of said conductor bar.

4. The electrode assembly of claim 1 wherein said gas baffle means is connected to each of said working faces and to only a single lower side of said conductor bar.

5. The electrode assembly of claim 1 wherein said conductor bar and said gas baffle means longitudinally, outwardly terminate inward of an outer edge of said two opposed working faces, so as to provide an electrolyte flow passageway between the outer end of said baffle and bar and said outer edge of said two opposed working faces.

6. The electrode assembly of claim 1 wherein:

a. said assembly further includes a membrane surrounding said conductor bar, working faces and gas baffle means; and b. an electrode support means for positioning and supporting said electrode assembly within an electrolytic cell, said working faces being spaced apart from said membrane at the end of said conductor bar adjacent said electrode support, so as to provide a gas flow passageway between the edge of said working face closest said support and the portion of said membrane closest said support.

7. The electrode assembly of claim 1 wherein said conductor bar, working faces and gas baffle means are surrounded by a diaphragm supported by said working faces.

8. The electrode assembly of claim 1 wherein said gas baffle means is of an inverted U-shaped configuration.

9. The electrode assembly of claim 1 which further comprises a non-removable restraint means attached to said working faces for maintaining said working faces in a first contracted position relative to each other and for releasing said working faces responsive to a signal external to said working faces, thereby allowing said working faces to expand under the biasing forces of said gas baffle means.

10. The electrode assembly of claim 1 which further comprises a non-removable restraint means attached to lower end portions of said gas baffle means for maintaining said lower end portions in a first contracted position relative to each other and for releasing said lower end portions responsive to a signal external to said working faces so as to allow said working faces to expand under the biasing force of said gas baffle means.

11. An expandable electrode assembly comprising:

a. at least two opposed working faces;

b. a biasing means, attached to each of said working faces, for biasing said faces away from each other so as to expandably bias said assembly;

c. adjustable contraction means, attached to said bias means, for contracting said bias means and moving said faces toward each other until said faces are in a first position spaced a selected distance from one another; and d. releasable restraint means for holding said faces in said first position and selectively releasing said faces to move from said first position to a second position spaced a greater distance from one another than said selected distance.

12. The electrode assembly of claim 11 wherein said contraction means is a flexible linkage.

13. The electrode assembly of claim 12 wherein said restraint means includes a latch bar attached to said working faces and a ratchet means on said linkage for engaging said latch bar so as to hold said faces in said first position and for disengaging said latch bar in response to an external signal applied to said ratchet means.

14. The electrode assembly of claim 13 wherein said ratchet means includes a push rod extending beyond an outer end of said working faces.

15. The electrode assembly of claim 11 wherein said working faces, bias means, contraction means and restraint means are surrounded by a diaphragm prior to release and expansion of said assembly.

16. The electrode assembly of claim 11 wherein said restraint means is permanently attached to said assembly.

17. An expandable electrode assembly comprising:

a. at least two opposed working faces;

b. bias means, attached to each of said working faces, for biasing said faces away from each other so as to expansively bias said assembly; and c. corrodable restraint means for holding said faces in a first position and releasing said faces to move from said first position to a second position spaced a greater distance apart than in said first position responsive to the corrosion of said restraint means by a corrodable metal, said movement being under the motive forces of said bias means.

18. The electrode assembly of claim 17 wherein said assembly is surrounded by a diaphragm.

19. The electrode assembly of claim 17 wherein said corrodable restraint means includes a plurality of overlapping lugs attached to said two opposed working faces and a corrodable wire passing through overlapping portions of said lugs.

20. The electrode assembly of claim 19 wherein said corrodable wire is a steel wire and wherein said electrode assembly is an anode assembly for use in an electrolytic cell.

21. The electrode assembly of claim 19 wherein said corrodable wire is aluminum and said electrode assembly is a cathode assembly for use in an electrolytic cell.

22. The electrode assembly of claim 17 wherein said bias means is a downwardly opening, U-shaped, spring conductor attached to each of said two opposed working faces.

* * * * *